US006371474B1

(12) United States Patent
Amano

(10) Patent No.: US 6,371,474 B1
(45) Date of Patent: Apr. 16, 2002

(54) SHEET FEEDING MECHANISM AND SHEET FEEDING METHOD

(75) Inventor: Takafumi Amano, Kawasaki (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/670,622

(22) Filed: Sep. 27, 2000

(51) Int. Cl.[7] ..... B65H 5/22

(52) U.S. Cl. ..... 271/3.02; 271/3.08; 271/157; 271/186; 414/790.3

(58) Field of Search ..... 271/3.01, 3.02, 271/3.03, 3.08, 9.01, 9.12, 157, 158, 186; 414/789.9, 790.3, 792.7

(56) References Cited

U.S. PATENT DOCUMENTS 3,378,251 A * 4/1968 Donabin ..... 271/186
4,727,397 A * 2/1988 Stemmle ..... 271/186
5,586,755 A * 12/1996 Hansen ..... 271/3.03
6,295,922 B1 * 10/2001 Salamone et al. ..... 414/790.3

FOREIGN PATENT DOCUMENTS

JP 9-278200 10/1997

* cited by examiner

*Primary Examiner*—H. Grant Skaggs
(74) *Attorney, Agent, or Firm*—Foley & Lardner

(57) ABSTRACT

When it is detected that a first containing section contains or is being supplemented with used paper sheets, a CPU feeds the used paper sheets one by one to a table incorporated in a housing tray in a second containing section, via a conveyance path. When the housing tray is filled with used paper sheets, the CPU stops feeding and conveyance of used paper sheets from the first containing section to the second containing section, and confirms whether a main body is operating or is in a late-night standby state. If it is confirmed that the main body is operating or is in the late-night standby state, the table in the second containing section is moved into the third containing section, thereby shifting the used paper sheet on the table to the third containing section. The used paper sheets placed in the third containing section are fed to the main body one by one when necessary.

8 Claims, 5 Drawing Sheets

SHEET FEEDING MECHANISM AND SHEET FEEDING METHOD

BACKGROUND OF THE INVENTION

This invention relates to a sheet feeding apparatus for use in a printer, a copy machine, etc. for feeding, one by one, sheets of paper contained in a sheet cassette or a sheet tray.

In the prior art, when feeding, one by one, stacked sheets of paper contained in a sheet feeding device such as a sheet cassette or a sheet tray, an end of the uppermost one of the sheets is pressed against a pickup roller by the force of an intermediate plate spring, and forwarded.

If, in this structure, used paper (one surface of which is printed with data, and the reverse surface of which is to be used) or recycled paper is reused as part of environmental protection, it is very possible that several sheets will be picked up simultaneously or no sheets will be picked up. This is because of high or uneven friction between sheets of this type.

In light of the above, Japanese Patent Application KOKAI Publication No. 9-278200, for example, discloses a technique for picking up only the uppermost one of sheets contained in a sheet tray, with the other sheets held by holding means.

When stacking used paper sheets as described above in a sheet feeding mechanism, however, end portions of the sheets are liable to be deformed, since it is very difficult to perfectly align these sheets before they are contained in the feeding mechanism, and hence they must be stacked therein more or less forcibly. As a result, defective feeding such as simultaneous feeding of several sheets, no feeding of sheets, etc. may often occur. To avoid such defective feeding, it is necessary to sufficiently align the sheets beforehand by, for example, joggling them, which requires a lot of time and effort. Because of this inconvenience, the ratio of reuse of used paper is kept low and environmental protection is not substantially enhanced.

BRIEF SUMMARY OF THE INVENTION

It is the object of the invention to provide a sheet feeding mechanism and a sheet feeding method, which can prevent deformation of end portions of paper sheets, thereby facilitating supplement of paper sheets and eliminating defective feeding of paper sheets.

To attain the object, the invention provides a sheet feeding mechanism comprising: a first containing section for containing paper sheets that are not aligned; a sheet feeding section for feeding the paper sheets, contained in the first containing section, at a low speed that enables the paper sheets to be separated from each other; a second containing section for containing the paper sheets supplied by the sheet feeding section; an aligning section for aligning the paper sheets, contained in the second containing section, in units of a predetermined number of paper sheets; a movement section for moving the paper sheets aligned by the aligning section so that their alignment is maintained, when the second containing section is filled with the aligned paper sheets; and a third containing section for containing the aligned paper sheets moved by the movement section so that their alignment is maintained, and for feeding, one by one, the aligned paper sheets contained therein.

The invention also provides a sheet feeding mechanism comprising: a first containing section for containing paper sheets that are not aligned; a sheet feeding section for feeding the paper sheets, contained in the first containing section, at a low speed that enables the paper sheets to be separated from each other; a conveyance section for conveying paper sheets fed by the sheet feeding section; a second containing section for containing paper sheets conveyed by the conveyance section; an aligning section for aligning paper sheets, contained in the second containing section, in units of a predetermined number of paper sheets; a movement section for moving the paper sheets aligned by the aligning section so that their alignment is maintained, when the second containing section is filled with the aligned paper sheets; and a third containing section for containing the aligned paper sheets moved by the movement section so that their alignment is maintained, and for feeding, one by one, the aligned paper sheets contained therein.

The invention further provides a sheet feeding method comprising: a first step of containing, in a first containing section, paper sheets that are not aligned; a second step of feeding the paper sheets, contained in the first containing section, at a low speed that enables the paper sheets to be separated from each other; a third step of containing, in a second containing section, the paper sheets fed in the second step; a fourth step of aligning the paper sheets, contained in the second containing section, in units of a predetermined number of paper sheets; a fifth step of moving the paper sheets aligned in the fourth step so that their alignment is maintained, when the second containing section is filled with the aligned paper sheets; and a sixth step of containing the aligned paper sheets moved in the fifth step so that their alignment is maintained, and feeding, one by one, the aligned and contained paper sheets.

DETAILED DESCRIPTION OF THE INVENTION

The embodiment of the invention will be described with reference to the accompanying drawings.

Figure 1:
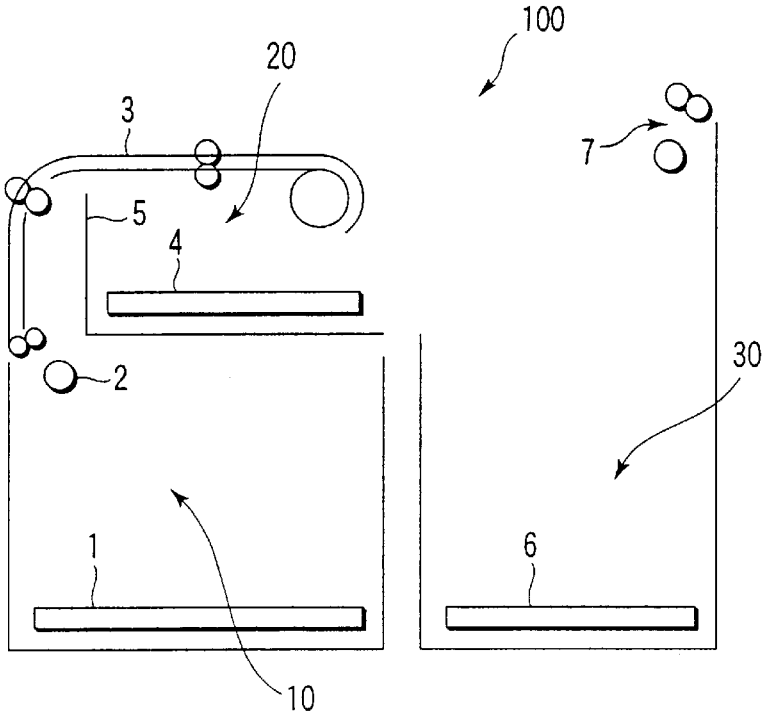
FIG. 1 is a schematic sectional view illustrating the structure of a sheet feeding mechanism according to the invention.

FIG. 1 shows the internal structure of a sheet feeding mechanism according to the invention.

In FIG. 1, a sheet feeding mechanism 100 comprises a first containing section 10 for containing, for example, used paper sheets (each of which has one surface thereof printed with data, and the reverse surface thereof now used), a second containing section 20 for feeding, separating and aligning the used paper sheets, and a third containing section 30, which will be described later in detail, for receiving paper sheets from the second containing section 20 after the section 20 is full, the third containing section 30 having a sheet feeding section 7.

The first containing section 10 is formed of a table 1 vertically movable with used paper sheets placed thereon, and a sheet feeding roller 2 for separating, from each other, the paper sheets placed on the table 1, and feeding each sheet to the second containing section 20. The first containing section 10 has a pair of guides (not shown) greater than a paper size so that a bundle of used paper sheets insufficiently aligned can be contained therein without deforming end portions of the sheets. This structure facilitates supplement of used sheets. Further, this section feeds paper sheets to the second containing section 20 at a low speed, thereby subserving the separation of the sheets, which will be described later in detail.

The second containing section 20 comprises a conveyance path 3 for conveying used paper sheets fed from the first containing section 10, a table 4 for mounting thereon used paper sheets conveyed through the conveyance path 3, the table 4 being movable to the third containing section 30, and a housing tray 5 for housing the table 4.

The third containing section 30 comprises a vertically movable table 6 for receiving used paper sheets from the table 4 of the second containing section 20 when the table 4 is moved into the section 30, and the sheet feeding section 7 for feeding, to a main body, the used paper sheets placed on the table 6.

Figure 2:
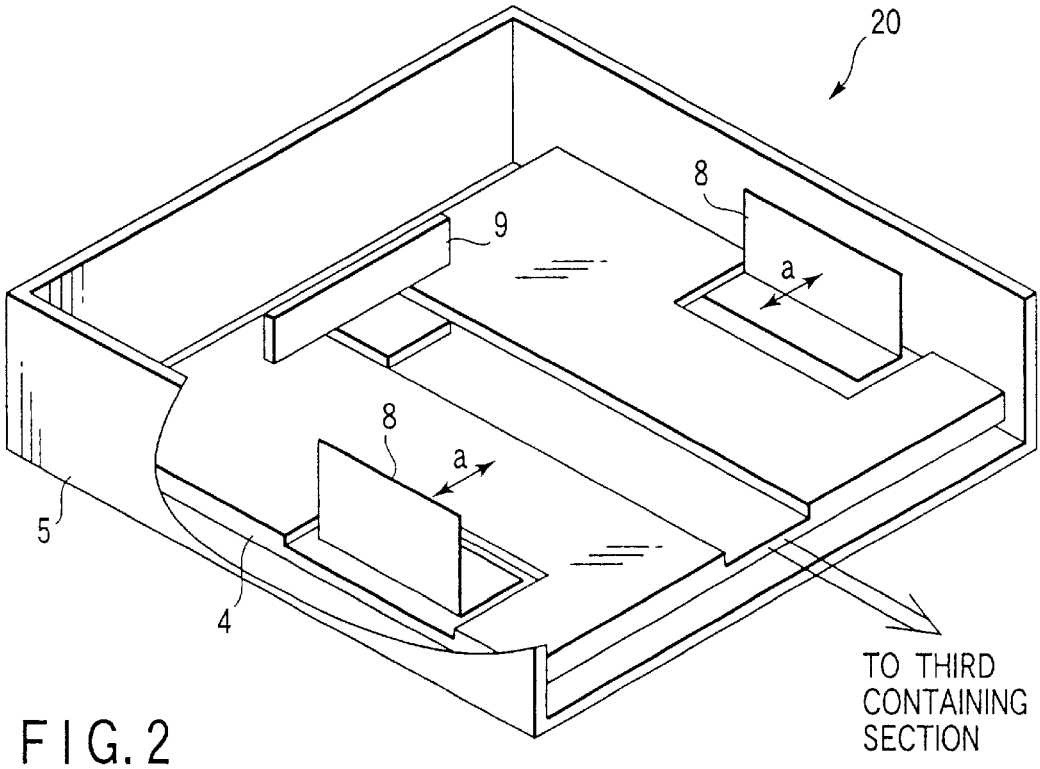
FIG. 2 is a view illustrating a second containing section.

FIG. 2 shows the structure of the housing tray 5 in the second containing section 20. In the second containing section 20, used paper sheets, guided thereto by the conveyance path 3 with their surfaces inverted, are placed on the table 4. The table 4 has side guides 8, 8 for aligning used paper sheets placed thereon, and a rear end guide 9, described later, for pushing out the used paper sheets. Each time five, for example, used paper sheets are stacked on the table 4, the side guides 8, 8 are moved by a motor, described later, (in directions indicated by arrow a in FIG. 2) to align the used paper sheets. A technique for moving a member like the side guide from side to side or slightly displacing the member, using a motor, is a well-known technique. This operation is repeated until the housing tray 5 is filled with used paper sheets. After the housing tray 5 is filled with used paper sheets, the table 4 is shifted to the third containing section 30.

Figure 3:
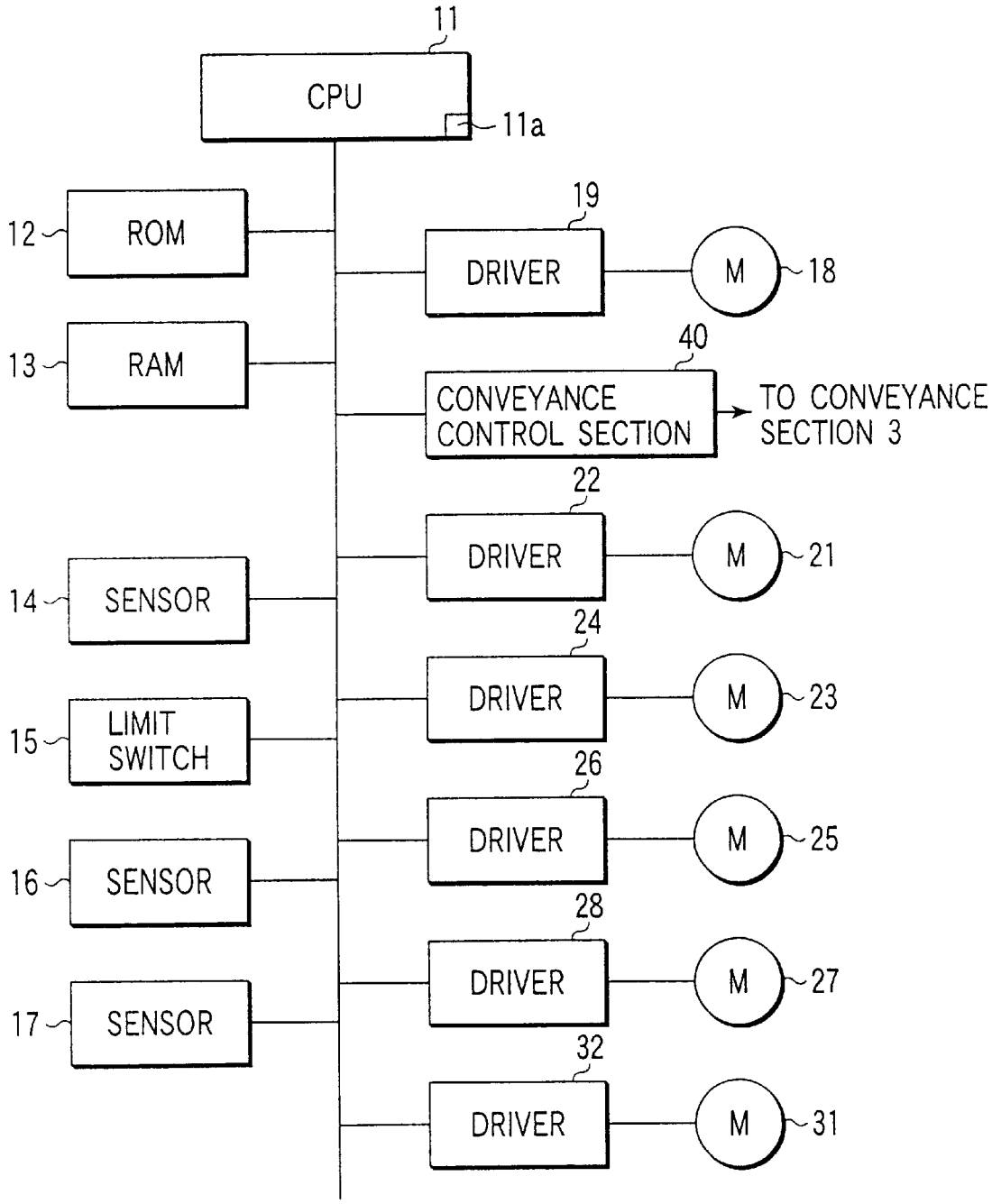
FIG. 3 is a block diagram showing a control system employed in the sheet feeding mechanism of the invention.

FIG. 3 shows the structure of a control system incorporated in the sheet feeding mechanism 100. The sheet feeding mechanism 100 comprises a CPU 11 for controlling the entire mechanism, a ROM 12 storing control programs, a RAM 13 for temporarily storing data, a sensor 14 for sensing whether or not the first containing section 10 contains any used paper sheet, a limit switch 15 for detecting whether or not used paper sheets placed on the table 4 fills the second containing section 20, a sensor 16 for sensing whether or not the amount of paper sheets placed on the table 6 in the third containing section 30 exceeds a predetermined value (when it exceeds the value, paper sheets cannot be shifted from the second containing section 20), a sensor 17 for sensing whether or not there is any paper sheet on the table 6 in the third containing section 30, a driver 19 for driving a motor 18 that vertically moves the table 1, a conveyance control section 40 for controlling the conveyance path 3, a driver 22 for driving a motor 21 that moves the table 4, a driver 24 for driving a motor 23 that moves the side guides 8, 8 of the table 4, a driver 26 for driving a motor 25 that moves the rear guide 9 of the table 4, a driver 28 for driving a motor 27 that vertically moves the table 6, and a driver 32 for driving a motor 31 incorporated in the sheet feeding section 7. Further, the CPU 11 has a timer 11a for confirming a late-night standby state.

Figure 4:
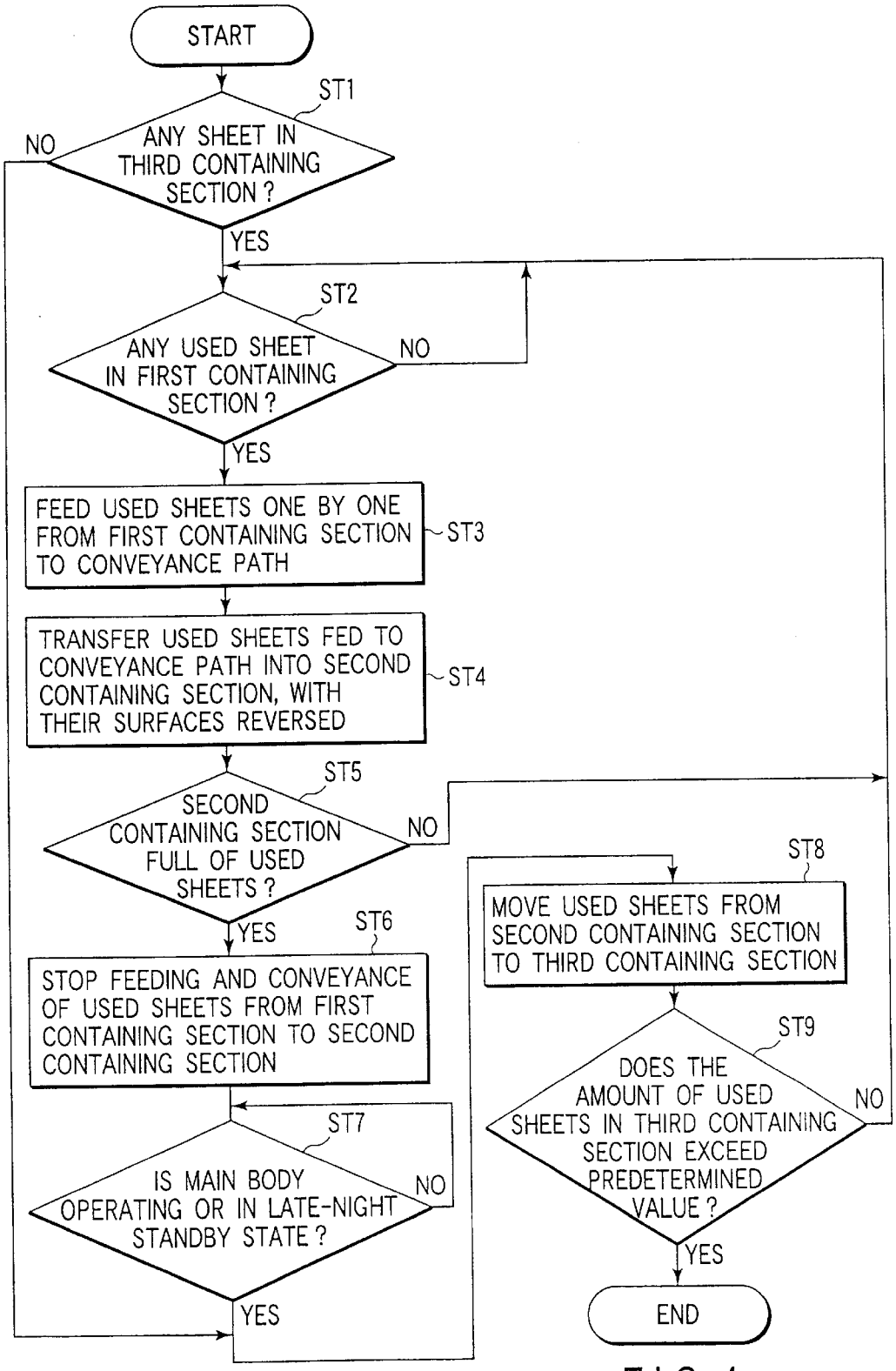
FIG. 4 is a flowchart useful in explaining the sheet feeding operation of the sheet feeding mechanism.

Referring then to the flowchart of FIG. 4, a description will be given of the feeding operation of the sheet feeding mechanism 100.

At first, when the sensor 17 has sensed that the third containing section 30 contains no paper sheets (ST1), the CPU 11 executes control of immediately moving paper sheets (used paper sheets) contained in the second containing section 20 (ST8), which will be described later in detail, in order to continuously supply paper sheets to the main body.

When the sensor 14 has sensed that the third containing section 30 contains used paper sheets, and used paper sheets are contained in the first containing section 10 or now being supplemented therein (ST2), the CPU 11 controls the driver 19 so as to drive the motor 18, thereby raising the table 1 and feeding used paper sheets one by one to the conveyance path 3 through the sheet feeding roller 2 (ST3). The sheet feeding speed at this time is lower than the speed of the known image forming operation, since separation of used paper sheets from each other is aimed at.

Subsequently, the CPU 11 controls the conveyance control section 40 so as to convey, on the conveyance path 3, the used paper sheets fed thereto, thereby reversing the sheets (reversing the sheets contained in the first containing section 10), and transferring the reversed paper sheets onto the table 4 of the housing tray 5 in the second containing section 20 (ST4). The sheet conveyance speed is also lower than the speed of the known image forming operation.

When the limit switch 15 has detected that the housing tray 5 is filled with used paper sheets (ST5), the CPU 11 stops feeding and conveying of used paper sheets from the first containing section 10 to the second containing section 20 (ST6), and confirms (using the timer 11a) whether the main body is now operating or is in the late-night standby state (ST7). If the main body is not operating or not in the late-night standby state, the sheet feeding mechanism 100 is made standby until the main body start to operate or shifts to the late-night standby state.

If it is determined at the step ST7 that the main body is operating or in the late-night standby state, the CPU 11 executes control of moving the used paper sheets on the table 4 of the second containing section 20, into the third containing section 30 (ST8).

Figure 5:
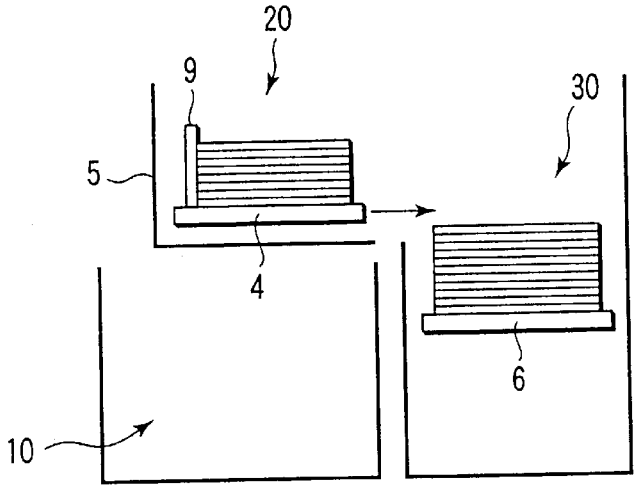
FIG. 5 is a view useful in explaining movement of used paper sheets.
Figure 6:
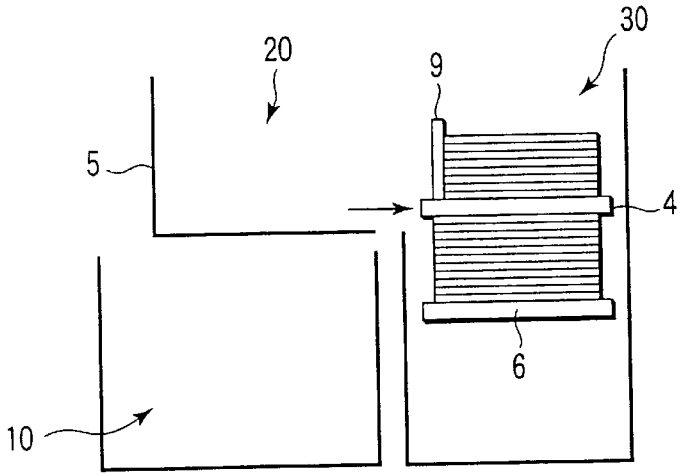
FIG. 6 is a view useful in explaining movement of used paper sheets.
Figure 7:
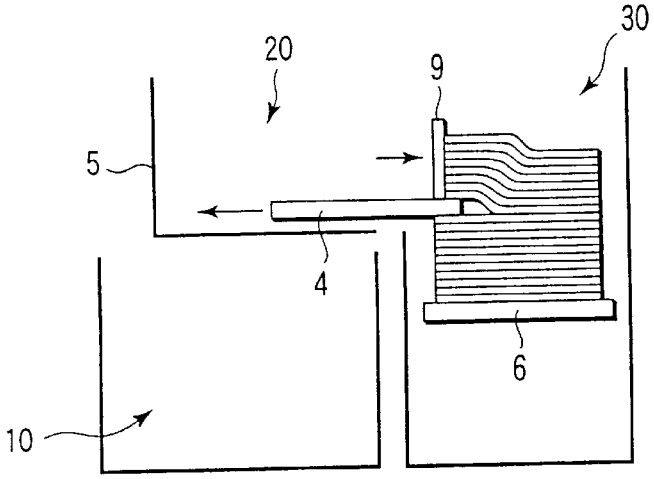
FIG. 7 is a view useful in explaining movement of used paper sheets.

FIGS. 5–7 are views useful in explaining the control of moving used paper sheets executed at the step ST8.

In FIG. 5, the CPU 11 controls the driver 22 so as to drive the motor 21 to move the table 4 in the direction of the third containing section 30 (to the right in FIG. 5 as indicated by the arrow).

In FIG. 6, the CPU 11 controls the driver 22 so as to stop the motor 21 after the table is shifted to above the table 6, i.e. after the table is shifted into the third containing section 30.

In FIG. 7, the CPU 11 controls the driver 22 so as to drive the motor 21 in a direction opposite to the above, thereby moving the table 4 in the direction of the second containing section 20 (to the left in FIG. 7 as indicated by the arrow). The CPU 11 simultaneously controls the driver 24 so as to drive the motor 23 to move the rear guide 9 (to the right in FIG. 7 as indicated by the arrow). As a result, the used paper sheets on the table 4 are pushed out onto those placed on the table 6.

Thus, the CPU 11 transfers the already-aligned used paper sheet on the table 4, onto the table 6 in the third containing section 30.

After that, the CPU 11 repeats the sheet feeding operations at the steps ST2–ST8, until the amount of the paper sheets (used paper sheets) in the third containing section 30 exceeds a predetermined value (ST9).

When the sensor 16 has sensed that the amount of the paper sheets (used paper sheets) in the third containing section 30 exceeds the predetermined value (ST9), the CPU 11 finishes the sheet feeding operations. The control may be modified such that even after finishing the sheet feeding operation, the sheet feeding operations at the steps ST2–ST5 are continued until the second containing section 20 is filled with used paper sheets.

The CPU 11 feeds aligned used paper sheets one by one from the third containing section 30 to the main body when necessary.

Figure 8:
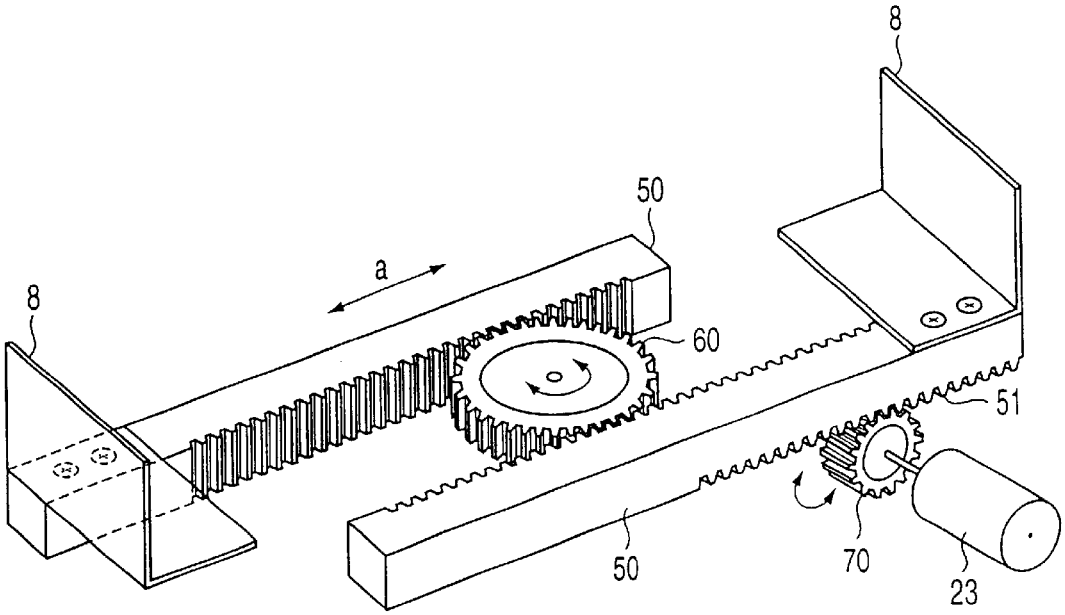
FIG. 8 is a view showing an example of a mechanism for operating side guides.

FIG. 8 shows an example of a mechanism for driving the side guides 8, 8, which are used for aligning used paper sheets and shown in FIG. 2. This mechanism is provided below the table 4 in FIG. 2 (although it is not shown in FIG. 2). The side guides 8, 8 are secured to respective racks 50 by means of, for example, screws. The two racks 50 are engaged with a pinion 60. One of the racks 50 is engaged with a gear 70 connected to the motor 23. The motor 23 is rotated by the driver 24 in both opposite directions. As a result, the racks 50 are moved in opposite directions to move the side guides 8, 8 so as to align the used paper sheets.

As described above, the embodiment of the invention aligns used paper sheets before they are fed, thereby minimizing defective sheet feeding.

Further, since guides provided in the containing section for aligning used paper sheets have an allowance, end portions of the paper sheets are prevented from being deformed, and supplement of used paper sheets is easy.

What is claimed is:

1. A sheet feeding mechanism comprising:

a first containing section for containing paper sheets that are not aligned;

a sheet feeding section for feeding the paper sheets, contained in the first containing section, at a low speed that enables the paper sheets to be separated from each other;

a second containing section for containing the paper sheets supplied by the sheet feeding section;

an aligning section for aligning the paper sheets, contained in the second containing section, in units of a predetermined number of paper sheets;

a movement section for moving the paper sheets aligned by the aligning section so that their alignment is maintained, when the second containing section is filled with the aligned paper sheets; and a third containing section for containing the aligned paper sheets moved by the movement section so that their alignment is maintained, and for feeding, one by one, the aligned paper sheets contained therein.

2. The sheet feeding mechanism according to claim 1, wherein the first containing section has guides larger than a paper sheet size so that the first containing section can contain paper sheets even if they are not aligned.

3. The sheet feeding mechanism according to claim 1, wherein the second containing section has a table for placing fed paper sheets thereon, the table having the aligning section.

4. The sheet feeding mechanism according to claim 1, wherein the aligning section includes sheet guides provided along opposite side of each paper sheet placed on the aligning section, and aligns the paper sheets by slightly moving or vibrating the sheet guides in a direction in which the paper sheets can be aligned.

5. The sheet feeding mechanism according to claim 1, wherein the movement section moves the table of the second containing section to the third containing section.

6. A sheet feeding mechanism comprising:

a first containing section for containing paper sheets that are not aligned;

a sheet feeding section for feeding the paper sheets, contained in the first containing section, at a low speed that enables the paper sheets to be separated from each other;

a conveyance section for conveying paper sheets fed by the sheet feeding section;

a second containing section for containing paper sheets conveyed by the conveyance section;

an aligning section for aligning paper sheets, contained in the second containing section, in units of a predetermined number of paper sheets;

a movement section for moving the paper sheets aligned by the aligning section so that their alignment is maintained, when the second containing section is filled with the aligned paper sheets; and a third containing section for containing the aligned paper sheets moved by the movement section so that their alignment is maintained, and for feeding, one by one, the aligned paper sheets contained therein.

7. The sheet feeding mechanism according to claim 6, wherein the conveyance section conveys each paper sheet to the second containing section, with surfaces of said each paper sheet reversed.

8. A sheet feeding method comprising:

a first step of containing, in a first containing section, paper sheets that are not aligned;

a second step of feeding the paper sheets, contained in the first containing section, at a low speed that enables the paper sheets to be separated from each other;

a third step of containing, in a second containing section, the paper sheets fed in the second step;

a fourth step of aligning the paper sheets, contained in the second containing section, in units of a predetermined number of paper sheets;

a fifth step of moving the paper sheets aligned in the fourth step so that their alignment is maintained, when the second containing section is filled with the aligned paper sheets; and a sixth step of containing the aligned paper sheets moved in the fifth step so that their alignment is maintained, and feeding, one by one, the aligned and contained paper sheets.

* * * * *